US007830307B2

(12) United States Patent
Asbridge, Jr.

(10) Patent No.: US 7,830,307 B2
(45) Date of Patent: Nov. 9, 2010

(54) ARRAY ANTENNA AND A METHOD OF DETERMINING AN ANTENNA BEAM ATTRIBUTE

(75) Inventor: Harold E. Asbridge, Jr., Rowlett, TX (US)

(73) Assignee: Andrew LLC, Hickory, NC (US)

( * ) Notice: Subject to any disclaimer, the term of this patent is extended or adjusted under 35 U.S.C. 154(b) by 76 days.

(21) Appl. No.: 11/735,091

(22) Filed: Apr. 13, 2007

(65) Prior Publication Data

US 2008/0252522 A1 Oct. 16, 2008

(51) Int. Cl.
*H01Q 3/26* (2006.01)

(52) U.S. Cl. ..... 342/360; 342/372

(58) Field of Classification Search ..... 342/360, 342/368, 372; 343/703
See application file for complete search history.

(56) References Cited

U.S. PATENT DOCUMENTS 3,900,823 A * 8/1975 Sokal et al. ..... 330/149
4,532,518 A * 7/1985 Gaglione et al. ..... 342/372
4,983,981 A * 1/1991 Feldman ..... 342/372
4,994,813 A * 2/1991 Shiramatsu et al. ..... 342/360
5,008,844 A * 4/1991 Kyriakos et al. ..... 702/106
5,119,042 A * 6/1992 Crampton et al. ..... 330/295
5,530,449 A * 6/1996 Wachs et al. ..... 342/174
5,917,455 A 6/1999 Huynh et al.
5,936,569 A * 8/1999 St.ang.hle et al. ..... 342/174
6,046,697 A * 4/2000 Overbury et al. ..... 342/360
6,133,868 A 10/2000 Butler et al.
6,157,340 A * 12/2000 Xu et al. ..... 342/174
6,320,540 B1 11/2001 Meredith
6,522,897 B1 2/2003 Martek et al.
6,603,436 B2 * 8/2003 Heinz et al. ..... 343/757
7,009,560 B1 * 3/2006 Lam et al. ..... 342/375
2004/0032365 A1 * 2/2004 Gottl et al. ..... 342/368
2004/0038714 A1 2/2004 Rhodes et al.
2004/0151265 A1 8/2004 Fisher et al.

* cited by examiner

*Primary Examiner*—Gregory C Issing
(74) *Attorney, Agent, or Firm*—Husch Blackwell LLP Welsh Katz

(57) ABSTRACT

A method of determining one or more attributes of an antenna beam based on measuring phase and/or amplitude differences at different points in a feed network. Amplitude and/or phase are measured by a probe (13) at an input to a differential variable element (7, 8, 9) and by a probe (14) at fewer than all of the outputs of the differential variable element. By using lookup tables based on actual measurements of antenna beam attributes for phase and/or amplitude differences at different points in a feed network computation may be simplified. The method enables a relatively inexpensive control circuit to be employed while providing accurate measurement of antenna beam attributes.

38 Claims, 4 Drawing Sheets

ARRAY ANTENNA AND A METHOD OF DETERMINING AN ANTENNA BEAM ATTRIBUTE

FIELD OF THE INVENTION

This invention relates to a method of determining an antenna beam attribute by measuring at least one phase or amplitude difference between signals in a feed network sufficient to characterize an attribute of the beam of the antenna and to an array antenna incorporating a control circuit for determining an antenna attribute. The invention is particularly suited for use in cellular telecommunications systems.

BACKGROUND OF THE INVENTION

Telecommunication providers are increasingly incorporating antennas having remotely adjustable beam characteristics. Such antennas may include adjustable down tilt, beam width, azimuth steering or more complex beam shaping. Where such adjustment is performed electrically (i.e. by altering the electrical characteristics of the feed path) it is desirable to be able to accurately measure the beam characteristics after adjustment.

Where electromechanical actuators are used the physical movement of such actuators may be monitored by sliding or rotating sensors such as potentiometers. Such sensors may require calibration at the time of manufacture, be prone to wear and may not represent the true phase shift produced by a phase shifting network due to non-linearities of the sensor or phase shifting network.

An alternative approach is to sense the phase or amplitude of signals supplied to each radiating element of an array and determine the beam shape based on relative phase or amplitude differences. This approach may require a large number of sensors and require complex calculations to determine the beam pattern. It may therefore be complex and expensive to implement.

It would be desirable to provide an inexpensive, reliable and accurate technique for determining antenna beam attributes utilizing a sensing arrangement and relatively low computational requirements.

Exemplary Embodiments

According to one exemplary embodiment there is provided a method of determining an attribute of a beam of an array antenna having a plurality of radiating elements fed by a feed network including one or more variable elements comprising:

a. measuring at least one of a phase and amplitude difference between signals at a plurality of points in the feed network, less than the number of radiating elements, sufficient to characterize an attribute of a beam of the antenna; and b. determining an attribute value of the beam of the antenna based on the measured difference.

According to another exemplary embodiment there is provided an array antenna comprising:

a. a plurality of radiating elements;

b. a feed network including one or more variable element feeding the radiating elements;

c. a plurality of probes, less than the number of radiating elements, including:

i. a first probe configured to sense a signal at a first point in the feed network; and ii. a second probe configured to sense a signal at a second point in the feed network; and d. a control circuit configured to receive signals from the first and second probes and to generate an antenna attribute signal based on one or more difference between the signals sensed by the first and second probes.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

DESCRIPTION OF EMBODIMENTS OF THE INVENTION

Figure 1:
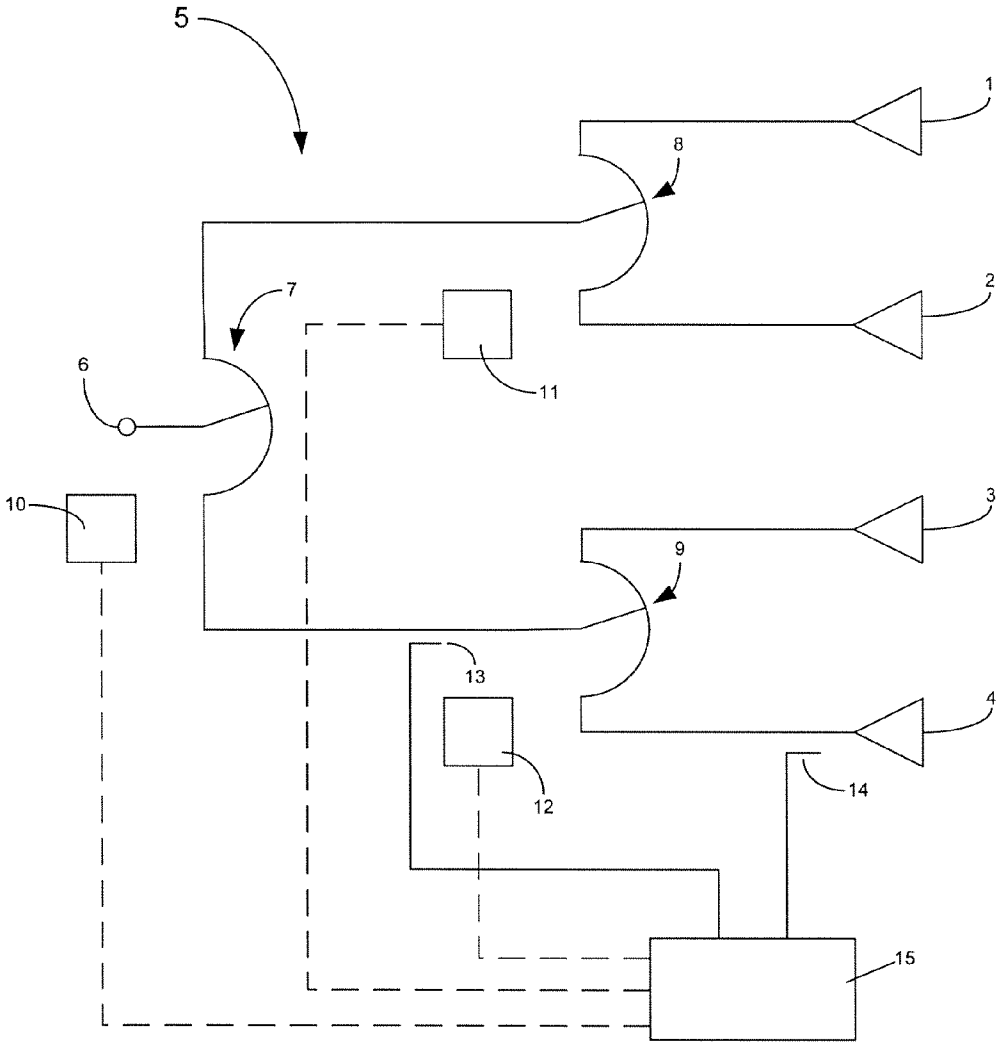
FIG. 1 shows a schematic view of an array antenna including probes sensing the phase difference between input and output signals of a variable element of a feed network.

Referring to FIG. 1 an array antenna according to a first embodiment is shown schematically. Radiating elements 1 to 4 are connected via a feed network 5 to a feed point 6. In this case the feed network 5 consists of three variable elements in the form of variable differential phase shifters 7, 8 and 9. In this case the phase shifters are electromechanical passive phase shifters driven by actuators 10, 11 and 12 which may be geared motors. It will be appreciated that for symmetrically driven phase shifters a single actuator may drive all phase shifters via an appropriate mechanical linkage.

Probes 13 and 14 sense signals at the input and output of phase shifter 9 and supply the sensed signals to control circuit 15. Control circuit 15 determines the phase and amplitude difference between the signals sensed by probes 13 and 14 and based on one or both of these difference values an attribute of the beam of the antenna may be determined.

In a first method an attribute of an antenna beam (such as down tilt, azimuth, beam width or beam shape) may be measured experimentally for one or a combination of difference values. Beam attribute values may be stored for successive difference values. These values may be stored within non-volatile memory of control circuit 15 in the form of a lookup table. In use the control circuit 15 may determine difference value(s) based on signals received from probes 13 and 14 and retrieve an antenna beam attribute value from the lookup table based on the difference value(s) supplies. Where difference values fall between stored values interpolation may be used to derive the antenna beam attribute value.

An attribute of an antenna beam may also be determined using an algorithm. Although this approach requires greater computational power the use of fewer probes simplifies the implementation.

Figure 2:
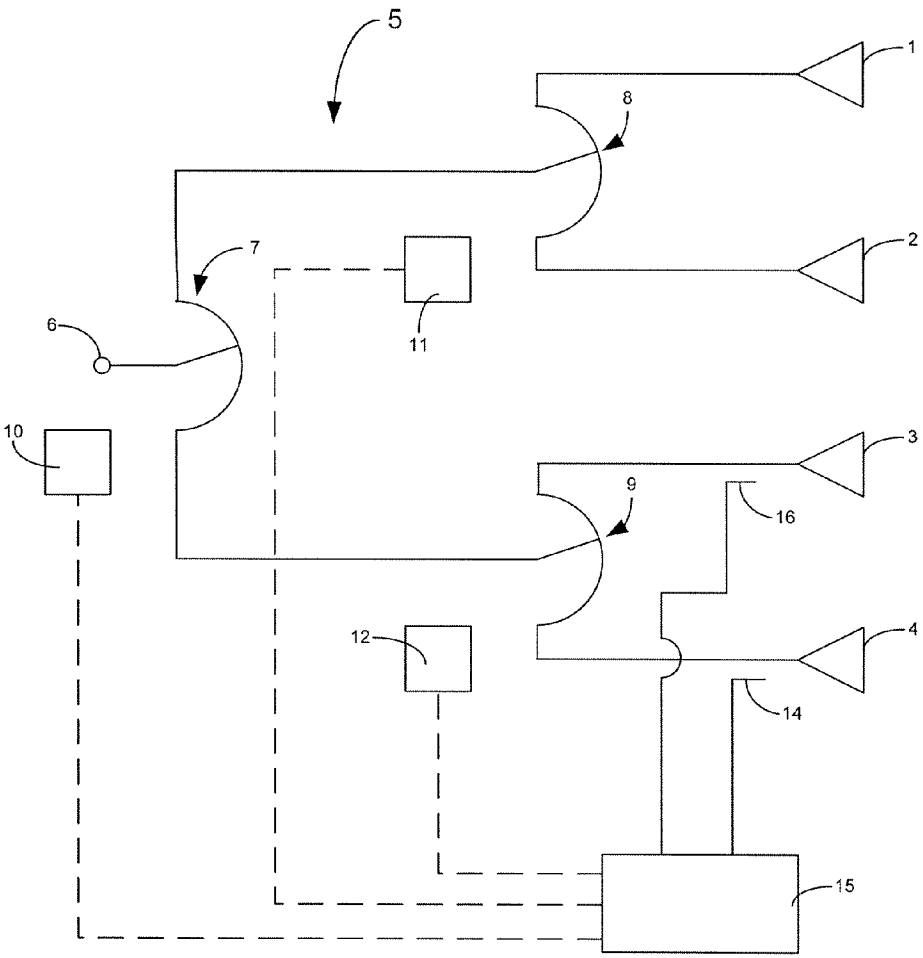
FIG. 2 shows a schematic view of an array antenna including probes sensing the phase difference between different outputs of a feed network.

FIG. 2 shows a variant of FIG. 1 where instead of sensing signal differences across a variable element, differences between output signals are sensed. Like elements to those shown in FIG. 1 have been given like number. In this case probe 16 replaces probe 13 so that the phase and amplitude difference between signals at radiating elements 3 and 4 may be detected. Otherwise operation is as per that described in relation to FIG. 1.

Figure 3:
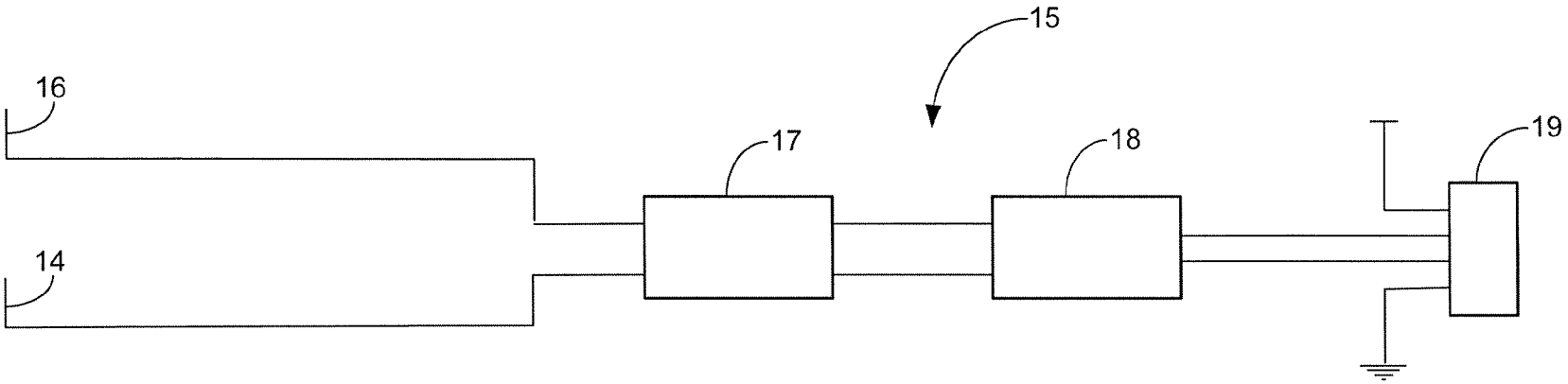
FIG. 3 shows a schematic diagram of a control circuit suitable for use in the array antenna of FIG. 2.

FIG. 3 shows a schematic view of the control circuit 15 shown in FIG. 2. Probes 14 and 16 supply signals to a magnitude (e.g. gain) and phase detector IC 17 (such as an AD8032 RF/IF Gain and Phase Detector) or discrete magnitude and phase detector circuitry, Phase and amplitude information is supplied from magnitude and phase detector 17 to a microcontroller 18 that has built-in A/D converters and non-volatile memory. A lookup table of phase and/or magnitude values for antenna attribute values (down tilt in this case) is stored in non-volatile memory. The phase and amplitude signals from magnitude and phase detector IC 17 are converted by the on-board A/D converters and used to obtain the antenna beam attribute value. In this case the phase difference is sufficient to obtain a unique down tilt value. It will be appreciated that where more probes are employed that further magnitude and phase detectors may be employed with their output signals multiplexed to the microcontroller. It will be appreciated that a wide range of circuits may be employed and the above circuits are given by way of example, although they do provide a cost effective solution. The microcontroller 18 may have desired antenna attribute values stored in its memory and may supply drive signals to actuators 10 to 12 via serial port 19 until the measured signal differences correspond to antenna beam attribute values within a permitted range. Alternatively antenna attribute information may be sent via serial port 19 to a master or remote controller which may send drive commands to control the actuators.

Figure 4:
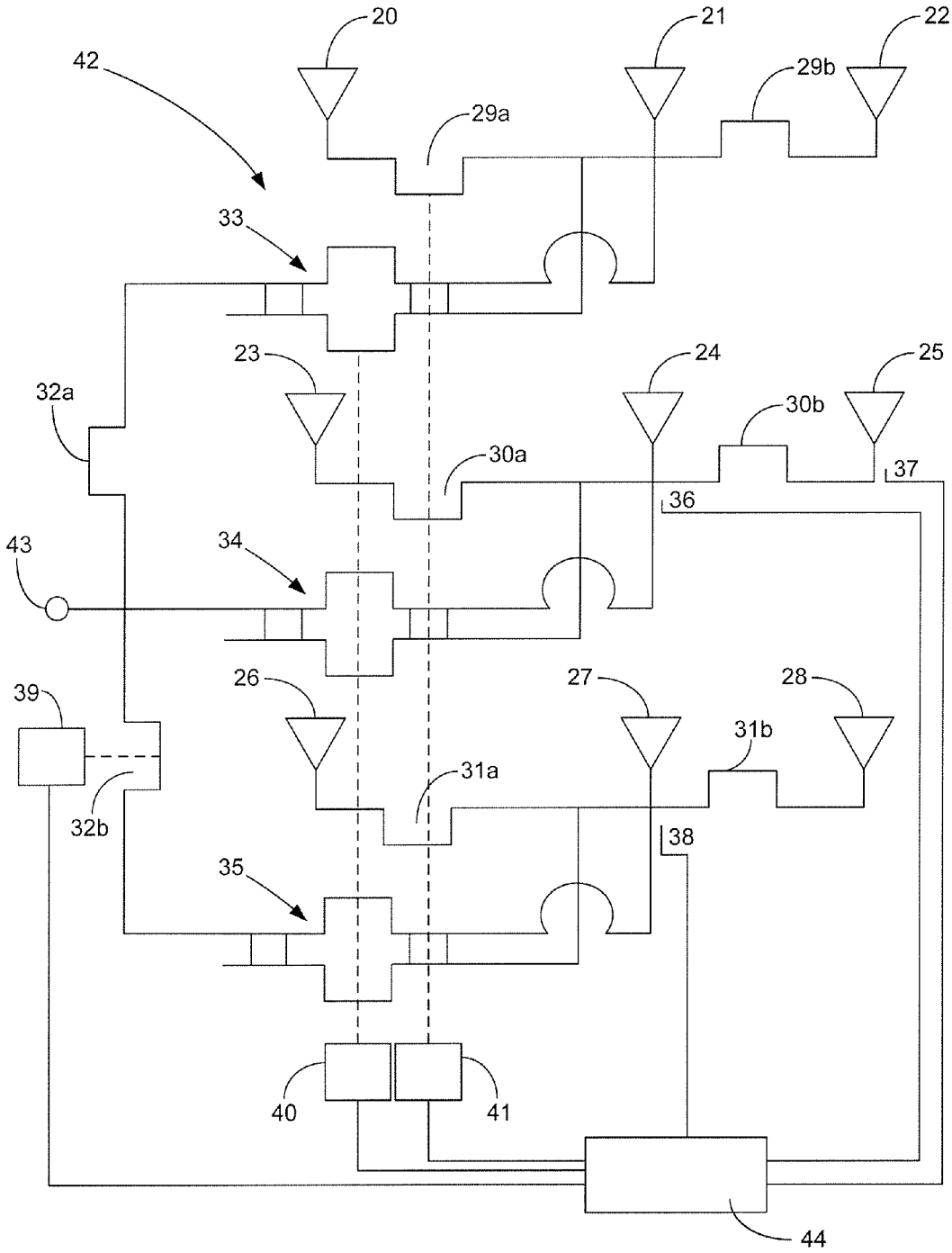
FIG. 4 shows a schematic view of an array antenna capable of steering an antenna beam in two planes and adjusting beam width including probes sensing the phase and amplitude difference between different points of a feed network.

FIG. 4 shows schematically an array antenna including a feed network 42 allowing antenna beam down tilt, azimuth steering and beam width adjustment. Feed point 43 is connected via feed network 42 to radiating elements 20 to 28. Feed network 42 includes a differential phase shifter 32*a*, 32*b* for adjusting antenna beam down tilt, differential phase shifters 29*a* to 31*b* for adjusting antenna beam azimuth steering and power dividers 33 to 35 for adjusting beam width. Actuator 39 drives differential phase shifter 32*a*, 32*b*; actuator 40 includes a common mechanical linkage driving power dividers 33 to 35; and actuator 41 has a common mechanical linkage driving phase shifters 29*a* to 31*b*.

Probes 36, 37 and 38 sense signals at various points in the feed network. The phase difference between signals at probes 36 and 38 can be used to determine down tilt, the phase difference between signals at probes 36 and 37 can be used to determine azimuth steering and the amplitude difference between signals at probes 36 and 37 can be used to determine beam width. As in previous examples control circuit 44 can determine the phase and amplitude differences and use these to retrieve antenna attribute values from a lookup table or the difference values may be used as the input to an algorithm to calculate attribute values.

Whereas the above examples describe symmetric beam variation it will be appreciated that variable elements may be adjusted asymmetrically, for example by independently adjusting one variable element. This may allow complex beam shaping to be performed. The required number of probes is dependent only upon the number of difference measurements required to uniquely characterize an antenna beam attribute. Whereas the calculation of such beam shaping may be complex the use of lookup tables allows the actual beam attributes to be measured for any combination of phase differences and so allows complex beam shapes to be realized simply by driving actuators to achieve desired signal difference values.

Whereas the invention has been described in relation to passive variable elements it will be appreciated that active elements such as PIN diodes may be used.

By sensing the actual phase shift or amplitude difference between points of a feed network beam attributes may be accurately determined. Where variable elements of a feed network are symmetrically driven the beam attributes may be characterized by sensing signals at only a few points. The use of lookup tables to determine beam attributes avoids the need for complex computation. There is thus provided a method of determining antenna beam attributes and an array antenna utilizing the method that is inexpensive, accurate and reliable with low computational requirements.

While the present invention has been illustrated by the description of the embodiments thereof, and while the embodiments have been described in detail, it is not the intention to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A method of determining an attribute of a beam of an array antenna having a plurality of radiating elements fed by a feed network including one or more variable elements comprising:

a. measuring at least one of a phase and amplitude difference between signals at a plurality of points in the feed network, less than the number of radiating elements, the plurality of points in the feed network comprising at least an input to and fewer than all of the outputs of a variable element having a plurality of outputs, the variable element comprising a differential variable element; and b. determining an attribute value of the beam of the antenna based on the measured difference.

2. A method as claimed in claim 1 wherein measuring at least one of the phase and amplitude difference further comprises measuring at least one of the phase and amplitude difference between output signals of a subset of variable phase shifters.

3. A method as claimed in claim 1 wherein an attribute value of the beam of the antenna is determined by finding a beam attribute value in a lookup table corresponding to the one or more measured differences.

4. A method as claimed in claim 3 wherein the attribute values in the lookup table are based on measured attributes of the antenna for measured differences at points in the feed network.

5. A method as claimed in claim 3 wherein the attribute values in the lookup table are based on one or more algorithm relating measured differences at points in the feed network to antenna attributes.

6. A method as claimed in claim 1 wherein the attribute is beam shape.

7. A method as claimed in claim 1 wherein the attribute is beam orientation.

8. A method as claimed in claim 1 wherein the attribute is beam down tilt.

9. A method as claimed in claim 1 wherein the attribute is beam azimuth.

10. A method as claimed in claim 1 wherein the attribute is beam width.

11. A method as claimed in claim 1 wherein one or more actuators is driven to adjust one or more variable elements of the feed network until the determined attribute value conesponds to a desired attribute value.

12. A method as claimed in claim 11 wherein the variable elements are passive elements.

13. A method as claimed in claim 11 wherein the one or more actuators is an electromechanical actuator.

14. A method as claimed in claim 11 wherein the one or more variable elements are phase shifters.

15. A method as claimed in claim 11 wherein the variable elements are driven asymmetrically.

16. A method as claimed in claim 11 wherein the variable elements are driven independently.

17. A method as claimed in claim 11 wherein control is effected by a controller within the antenna.

18. A method as claimed in claim 11 wherein data relating to measured signal values is communicated to a remote controller which generates drive signals to control the variable elements.

19. An array antenna comprising:

a. a plurality of radiating elements;

b. a feed network including one or more variable element feeding the radiating elements, the one or more variable element comprising at least one differential variable element having an input and at least a first output and a second output;

c. a plurality of probes, less than the number of radiating elements, including at least:

i. a first probe configured to sense a signal at a first point in the feed network, the first point comprising the input to the differential variable element; and ii. a second probe configured to sense a signal at a second point in the feed network, the second point comprising the first output from differential variable element; and d. a control circuit configured to receive signals from the at least first probe and second probe and to generate an antenna attribute signal based on one or more difference between the signals sensed by the at least first probe and second probe.

20. An array antenna as claimed in claim 19 wherein the control circuit includes a lookup table relating probe signals to attribute values.

21. An array antenna as claimed in claim 20 wherein the attribute values are based on measured attributes of the array antenna beam over a range of probe signal values.

22. An array antenna as claimed in claim 20 wherein the control circuit calculates intermediate attribute values by interpolation.

23. An array antenna as claimed in claim 20 wherein attribute values are calculated for measured probe signals according to one or more algorithm.

24. An array antenna as claimed in claim 20 wherein the lookup table is non-volatile memory.

25. An array antenna as claimed in claim 19 wherein the control circuit includes one or more magnitude and phase detectors.

26. An array antenna as claimed in claim 25 wherein the magnitude and phase detector receives signals from two probes.

27. An array antenna as claimed in claim 19 including one or more actuator configured to drive the one or more variable elements in dependence upon the signals sensed by the probes.

28. An array antenna as claimed in claim 27 wherein the one or more variable elements are passive elements.

29. An array antenna as claimed in claim 28 wherein the one or more variable elements are phase shifters.

30. An array antenna as claimed in claim 27 wherein the one or more actuators are electromechanical actuators.

31. An array antenna as claimed in claim 27 wherein the control circuit controls the one or more actuators based on the antenna attribute signal and a demand signal.

32. An array antenna as claimed in claim 31 wherein the demand signal is stored in the control circuit.

33. An array antenna as claimed in claim 31 wherein the demand signal is received via a communication port of the control circuit.

34. An array antenna as claimed in claim 33 wherein the demand signal is received via a serial port.

35. An array antenna as claimed in claim 33 wherein the demand signal is received via a wireless link.

36. An array antenna as claimed in claim 33 wherein the demand signal is received via a feed line supplying RF signals to the feed network.

37. A system comprising a plurality of array antennas as claimed in claim 19 and a central controller wherein the array antennas are configured to communicate antenna attribute signals to the central controller and to receive demand signals from the central controller.

38. An array antenna comprising:

a. a plurality of radiating elements;

b. a feed network including at least first and second differential variable elements coupled to the radiating elements;

c. a plurality of probes, less than the number of radiating elements, including at least:

i. a first probe configured to sense a signal at a first point in the feed network, the first point comprising an output from the first differential variable element; and ii. a second probe configured to sense a signal at a second point in the feed network, the second point comprising an output from the second differential variable element; and d. a control circuit configured to receive signals from the at least first probe and second probe and to generate an antenna attribute signal based on one or more difference between the signals sensed by the at least first probe and second probe.

* * * * *